United States Patent [19]

Peck

[11] Patent Number: 4,691,683

[45] Date of Patent: Sep. 8, 1987

[54] BOW STRING RELEASE

[75] Inventor: Paul L. Peck, Fond du Lac, Wis.

[73] Assignee: Archery Designs, Inc., Fond du Lac, Wis.

[21] Appl. No.: 906,564

[22] Filed: Sep. 8, 1986

Related U.S. Application Data

[63] Continuation-in-part of Ser. No. 716,627, Mar. 27, 1985, abandoned.

[51] Int. Cl.[4] ..... F41C 19/00

[52] U.S. Cl. ..... 124/35 A

[58] Field of Search ..... 124/35 A, 35 R, 25

[56] References Cited

U.S. PATENT DOCUMENTS

| | | | |
|---|---|---|---|
| 3,998,202 | 12/1976 | Boyko | 124/35 A |
| 4,257,386 | 3/1981 | Gazzara | 124/35 A |
| 4,485,798 | 12/1984 | Hamm | 124/35 A |

*Primary Examiner*—Richard C. Pinkham

*Assistant Examiner*—Benjamin Layno

*Attorney, Agent, or Firm*—Bayard H. Michael

[57] ABSTRACT

The bow string release has a sear pivotally mounted in a cylindrical body and includes a string retaining finger which projects across the string receiving notch when the sear is engaged by a pull pin biased to the sear engaging position, the pull pin is slideable in a guide sleeve rotatably mounted in the end wall of the body to which it is coupled. A handle is rotatably mounted on said sleeve and carries a trigger through which the pull pin passes. When the trigger is actuated it rocks about its point of engagement with a washer to push another washer against an enlarged head on the end of the pin to pull the pin to release the sear. In one embodiment a screw in the handle and bearing on the trigger can be adjusted to "partly actuate" the trigger to adjust the stroke necessary to release the bow string. In a second embodiment a screw moves the enlarged head relative to the thrust washer to partly pull the pin for the same purpose.

10 Claims, 6 Drawing Figures

BOW STRING RELEASE

This is a continuation-in-part of co-pending application Ser. No. 716,627 filed on Mar. 27, 1985, and abandoned on Sept. 8, 1986.

BACKGROUND OF THE INVENTION

Bow string releases have grown in popularity for target shooting and for hunting. A good release provides uniform "let-off" which increases accuracy. A release should provide for adjustment of the trigger stroke and should allow adjustment of the relative angular relationship between the handle and the bow string. U.S. Pat. No. 4,485,798 provides for these adjustments but the adjustments are interdependent in that adjusting one affects the other.

It is an object of this invention to provide a release in which the adjustments are independent of one another.

SUMMARY OF THE INVENTION

The invention provides a bow string release including a cylindrical body having a string receiving notch in one end and a hole through the other end. A sear is pivoted in the body adjacent the notch and has a string retaining finger to retain a bow string in the notch when the sear is in its operative position. A guide sleeve is mounted in the hole in the end of the body and projects from the body and away from the notch. The sleeve is coupled to the body to prevent axial separation of the sleeve and body. A pull pin is slidably mounted in the sleeve for movement between a first position in which it engages the sear to retain the sear in its operative position and a second, retracted, position in which it releases the sear. A spring biases the pin to the first position. A handle is mounted on and coupled to said sleeve and has a trigger engaging the pin to pull the pin to its retracted position.

A further feature is that the handle and trigger are rotatable relative to the body.

Another feature is that the trigger stroke can be adjusted without affecting the adjustment of the handle relative to the body. In one version the adjustment adjusts the trigger position relative to the handle while another version makes the adjustment at a point between the trigger and the pull pin. Both versions end up adjusting the extent to which the pin overlaps the sear.

BRIEF DESCRIPTION OF THE DRAWINGS

FIG. 1 is a vertical section through the simplest embodiment of the present invention.

In FIGS. 1 and 2, the position of the handle relative to the bow string notch is offset about 90° from the position in which most users would use the release. This orientation permits showing all the parts in one view. It will be understood that in these three views, the barrel and hence the pivoted sear, etc. can be rotated 90° with ease.

DETAILED DESCRIPTION OF THE DRAWINGS

Figure 2:
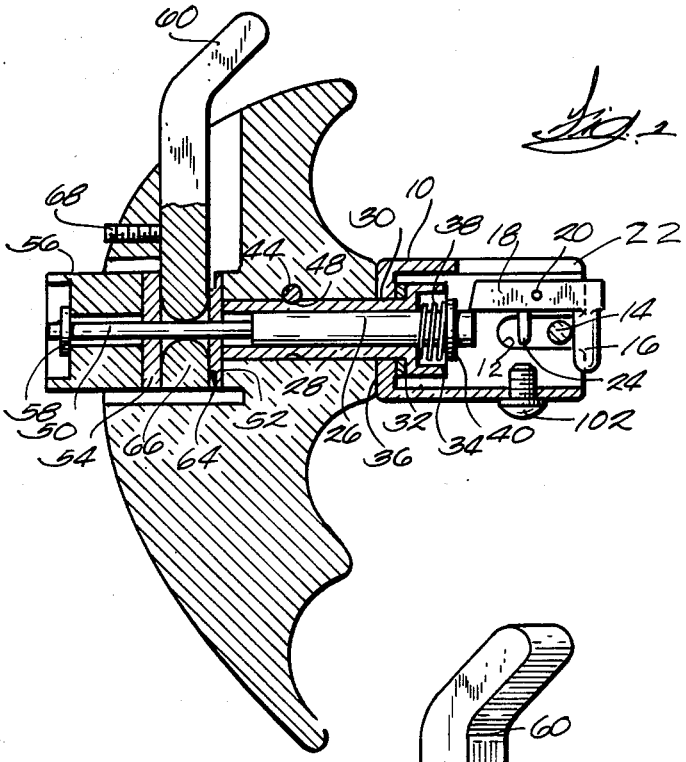
FIG. 2 is a vertical section of a somewhat more complicated embodiment designed to minimize the effects of friction between the user's fingers and the release in the manner shown in FIG. 3 which is a fragmentary, vertical elevation of the release in use.
Figure 4:
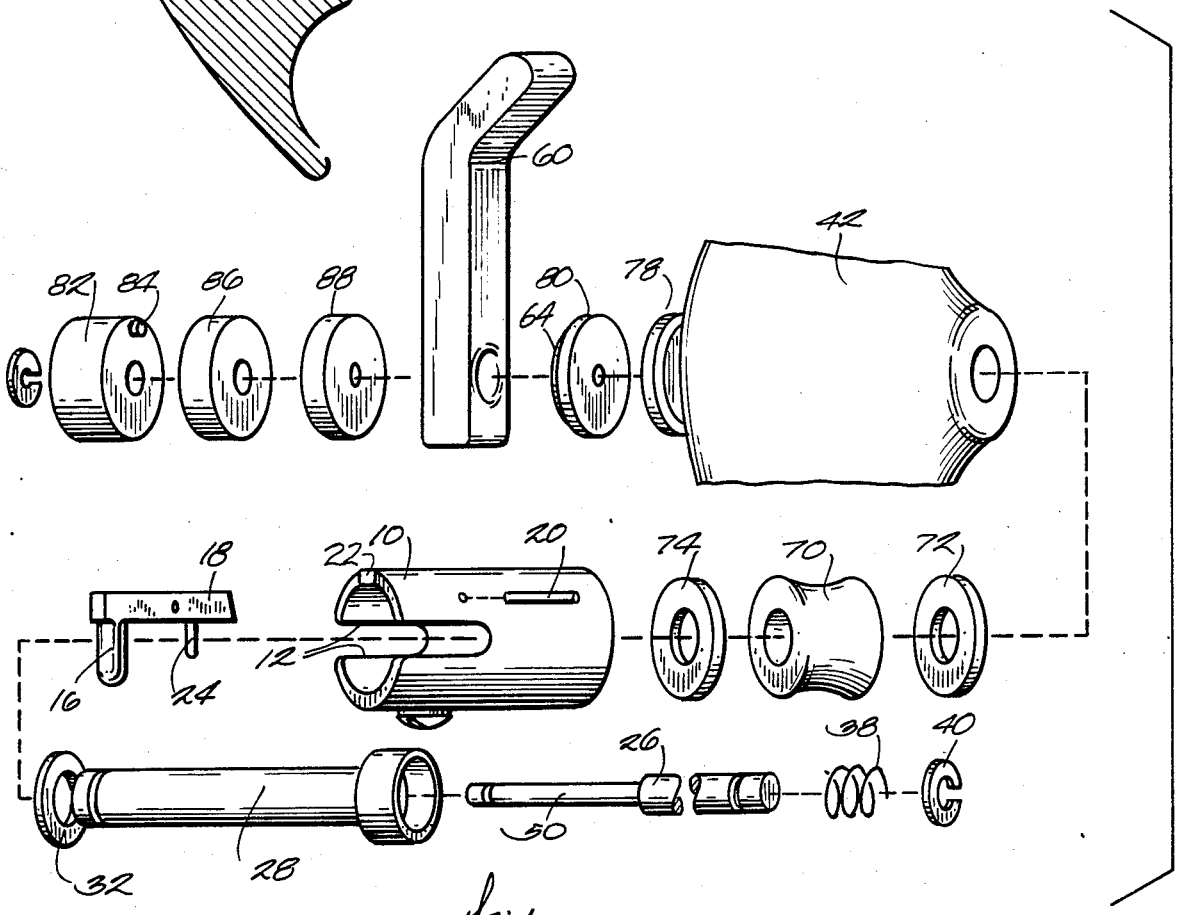
FIG. 4 is a fragmentary exploded view showing assembly of the parts of the FIG. 2 embodiment.

The release shown in FIG. 1 has a body or barrel 10 having diametrically opposed slots 12 to receive bow string 14 for retention by the retaining finger 16 projecting at right angles from the sear 18 pivoted in the barrel on roll pin 20 just under the slot 22 which permits the sear freedom of movement relative to the body. The sear is also provided with a projecting reset finger 24 against which the bow string can be pushed to move the sear clockwise (FIG. 1) to permit the round end of the spring loaded round plunger or pull pin 26 to slide under the left end of the sear 18 to retain it in its cocked position. As the release is moved to draw the bow string, the bow string will act against the retaining finger 16 trying to move the pin in a counterclockwise direction, but the sear is prevented from such movement by its engagement with the pull pin 26.

The pull pin 26 is guided in sleeve 28 which is mounted in a hole 30 in the barrel 10 with a suitable plastic or brass thrust washer 32 between the inturned end wall 36 of the barrel 10 and the enlarged cup-like head 34 of the sleeve 28 to couple the sleeve 28 to the barrel 10. Thus, the barrel and the sleeve 28 cannot be axially separated (in the pull direction). A spring 38 compressed between the cup-like head 34 of the sleeve and the C-ring 40 mounted in a groove in the pull pin biases the pull pin to the right into operative engagement with the sear 18. The degree of movement of the pull pin to the right is limited, as hereafter explained.

In this embodiment, handle 42 is rotatably mounted on sleeve 28 and is axially fixed with respect to the sleeve by roll pin 44 passing through the holes 46 in the handle and engaging groove 48 in the sleeve 28. This permits the handle to rotate on the sleeve.

The left end (FIG. 1) of the pull pin 26 has a reduced diameter portion 50 which passes through washers 52, 54 and the hole in the head 56 and is provided with a C-ring 58 capturing the head 56 so that if the head 56 moves to the left, the pull pin 50/26 will be pulled to the left and moved out from under the end of the sear 18 causing the bow string to be released.

Pull pin 50/26 passes through the aperture in trigger 60 to capture the trigger on the pull pin between the washers 52, 54. The trigger is mounted in the slot 62 in the handle 42. If the trigger is moved to the right in FIG. 1, it will pivot about the corner 64 at the reduced diameter portion of washer 52 and this will move the portion 66 of the trigger to the left causing the pull pin to be moved to the left to release the sear. It will be apparent that the movement of the pull pin to the right under the influence of the compressed spring 38 can be limited by adjusting the screw 68 to turn it inwardly to partially move the trigger to the right in FIG. 1, thus partially pulling the pin. In this way, the trigger can be "haired" to the user's desire.

In the FIG. 1 embodiment, the handle and trigger can be rotated about the sleeve 28 to position the handle relative to the bow string notch in the barrel at the most comfortable position. This is a free rotation. When the handle is pulled to the left, the pull is transmitted to the sleeve 28 through the roll pin 44 and then the thrust is transmitted through washer 32 to the barrel 10 and hence the string is drawn. The sleeve 28 passes through a hole in the body 10 with thrust washer 32 between the inside of the end of the body and the enlarged cup-like head 34 of the sleeve. The head on the sleeve couples the sleeve to the body. The brass thrust washer functions as a thrust bearing and allows unlimited rotation of the body relative to the sleeve. There is slight rotation each time the release is operated. This rotation allows the sear 18 to move relative to the pull pin 26 so the parts wear evenly. The ability to rotate the body relative to the head also helps in adjusting the pull of the trigger since rotation of the body does not adversely affect engagement of the pull pin with the sear. Since the body can rotate relative to the sleeve, there is very little frictional resistance to rotation of the body relative to the handle. The handle can rotate relative to the sleeve. The body and handle are easily rotated relative to one another.

Some prior art devices changed the engagement of the pull pin with the sear when the handle was rotated. This changed the adjustment of the stroke. The prior art generally fixed the pin and sear so all wear was concentrated in one spot causing the release to be worn out rapidly.

Figure 3:
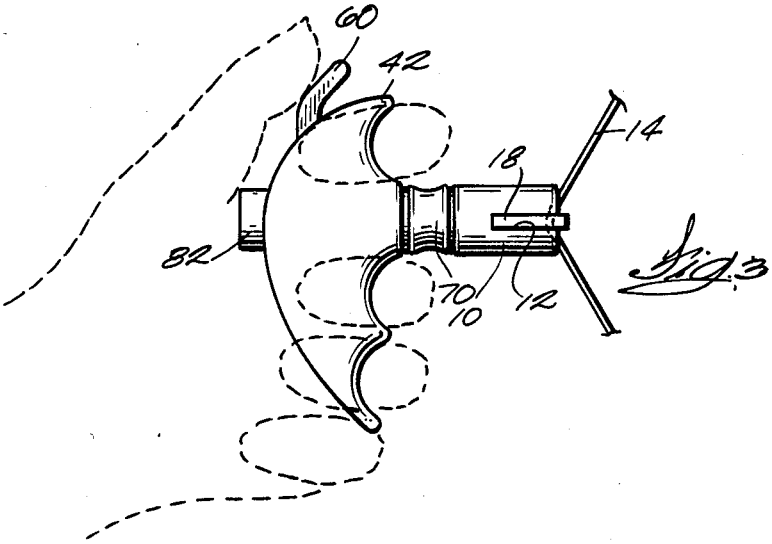
Figure 5:
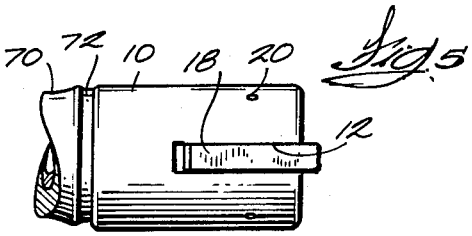
FIG. 5 is a detailed view showing the manner in which the sear is pivoted in the body.
Figure 2:
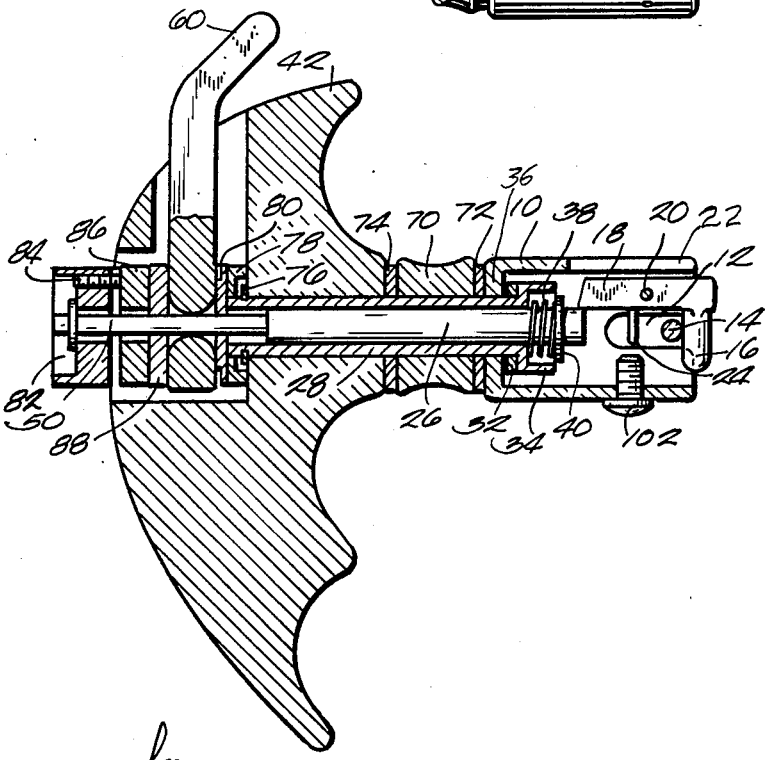
Figure 6:
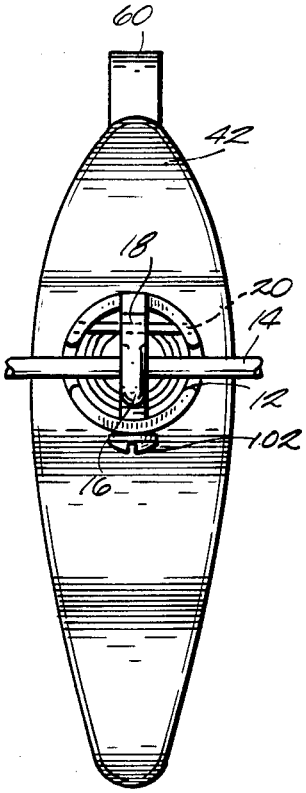
FIG. 6 is an elevation taken from the right in FIG. 2.

In use, the low bow string is drawn as generally indicated in FIG. 3. When the release of FIG. 1 is drawn, the free rotation of the barrel 10 relative to the handle 42 may be somewhat impared by reason of the engagement of the user's fingers with the rear end of the barrel 10. This slight frictional drag can, in some cases, be bothersome to an archer. The construction shown in FIG. 2 avoids the problem. This construction differs from FIG. 1 in several respects. It differs in having the spool 70 mounted on sleeve 28 between washers 72, 74. This spool is in the area likely to be engaged by the user's fingers as seen in FIG. 3. Since the spool is freely rotatable on the spindle 28, any frictional engagement between the user's fingers and the barrel is obviated.

In the FIG. 2 embodiment, the handle 42 is not connected to the sleeve 28 by means of a pin 44, etc., but the rear end of the sleeve 28 is provided with a groove receiving the C-ring 76 which will take the thrust as the handle 42 is drawn back. A washer 78 with an inner relief fitting over the C-ring acts as a spacer while the stepped washer 80 provides the same function as the stepped washer 52 in FIG. 1.

Adjustment of this embodiment is effected in a different manner than in FIG. 1. Here the pull pin 50/26 extends through the pull pin head 82 provided with an adjusting screw 84 which bears on washer 86 and hence indirectly on washer 88 and the trigger 60. The stack of washers continues through the washer 80 and 70. Therefore, when the screw 84 is turned in, it acts against the pull head 82 and pull pin 50/26 to the left and "hair" the trigger. The adjusting screw is directly in the pull pin head 82 rather than running through the handle as in FIG. 1. This is a lower cost construction.

Both embodiments are provided with a stop 102 to prevent the sear from spinning around its pivot when released. The stop is a Nylon screw threaded through the barrel wall to project into the cavity. It can be easily replaced when worn out by the battering it will receive.

It may be noted the pressure required to actuate the trigger is determined by the diameter of the inner corner 64 of the stepped washer 52 (or 80) since this determines the lever ratio (the distance between 64 and the (thumb) end of the trigger compared to the pivot corner 64 and the point of contact of the short end of the trigger with washer 54). The "length" of the "short end" of the trigger can also be shortened to decrease the actuation force.

I claim:

1. A bow string release comprising, a body having a string receiving notch in one end of said body and a hole through the other end of said body, a sear pivoted in the body adjacent said notch and having string retaining means operative to retain a bow string in said notch when said sear is in its operative position, a guide sleeve mounted in said hole and projecting from said body away from said notch, said sleeve having an enlarged head inside said body larger than said hole to couple said sleeve and said body for unlimited relative rotation and to prevent axial separation of said sleeve from said body, a pull pin slidably mounted in said body and said sleeve for movement between a first position and a retracted position, said pin engaging said sear in said first position to retain said sear in said operative position and releasing said sear upon movement to said retracted position, spring means biasing said pin to said first position, handle means rotatably mounted on and coupled to said sleeve to prevent axial separation of said handle means and said sleeve, trigger means engaging said handle means and said pin and operative to pull said pin to said retracted position.

2. A bow string release according to claim 1 in which said handle means includes a main portion rotatable on said sleeve and a grip portion engagable by the user's hand.

3. A bow string release according to claim 1 in which said pull pin is rotatable with respect to said sear and said sleeve, and said handle means is rotatable with respect to said sleeve.

4. A bow string release according to claim 3 including a spool rotatably mounted on said sleeve between said handle means and said body, said spool being rotatable relative to said body and said handle means.

5. A bow string release according to claim 1 in which said pull pin obstructs and overlaps said sear when in said first position the distance by which said pin overlaps said sear determining the trigger travel necessary to release said sear, and including means for adjusting said distance.

6. A bow string release according to claim 5 in which said adjusting means comprises adjustable stop means acting between said handle means and said trigger means to move said trigger in the release direction.

7. A bow string release according to claim 5 in which said adjusting means comprises means acting to limit movement of said pull pin in the direction of said first position.

8. A bow string release according to claim 7 including an enlarged head on the end of said pull pin remote from said sear, said trigger means having an aperture through which said pin projects and being moveable from a cocked position to a release position, means acting between said trigger means and said enlarged head to move said enlarged head and said pin to said retracted position, said adjusting means limiting movement of said trigger means between said cocked position and said release position.

9. A bow string release according to claim 8 in which said adjusting means limits movement of said trigger means by acting between said handle means and said trigger means.

10. A bow string release according to claim 8 including thrust means between said trigger means and said enlarged head, and said adjusting means comprising means to vary the space between said enlarged head and said trigger means.

* * * * *